United States Patent [19]

Mitamura et al.

[11] 4,419,602

[45] Dec. 6, 1983

[54] ELECTRIC LAMP

[75] Inventors: Zenzou Mitamura, Yokohama; Takashi Oosawa, Tokyo; Akihiro Yonezawa, Yokosuka, all of Japan

[73] Assignee: Tokyo Shibaura Denki Kabushiki Kaisha, Kawasaki, Japan

[21] Appl. No.: 341,570

[22] Filed: Jan. 21, 1982

[30] Foreign Application Priority Data

Jan. 23, 1981 [JP] Japan ..... 56-7885

[51] Int. Cl.[3] ..... A47B 88/00; A47B 95/00

[52] U.S. Cl. ..... 313/332

[58] Field of Search ..... 313/317, 318, 326, 331, 313/332, 623, 624, 625

[56] References Cited

U.S. PATENT DOCUMENTS

| | | | |
|---|---|---|---|
| 3,753,026 | 8/1973 | Goorissen | 313/332 |
| 4,101,799 | 7/1978 | Wiedijk et al. | 313/331 |
| 4,131,718 | 12/1978 | Childeric | 313/330 |
| 4,254,300 | 3/1981 | Thompson-Russell | 313/331 |

FOREIGN PATENT DOCUMENTS

| | | | |
|---|---|---|---|
| 664845 | 6/1963 | Canada | 313/332 |
| 1521129 | 8/1978 | United Kingdom | 313/332 |

*Primary Examiner*—David K. Moore
*Assistant Examiner*—Robert E. Wise
*Attorney, Agent, or Firm*—Oblon, Fisher, Spivak, McClelland & Maier

[57] ABSTRACT

The molybdenum foil coupling member is disclosed in which potassium (K) and silicon dioxide ($SiO_2$) are respectively dispersed in the range from 200 to 800 ppm and from 200 to 2000 ppm so as to resist to fracturing upon exposed to high temperature. This coupling member is particularly well suited for used in electric lamps having quartz glass envelopes which are pinch sealed at either end.

4 Claims, 2 Drawing Figures

ELECTRIC LAMP

BACKGROUND OF THE INVENTION

1. Field of the Invention

This invention generally relates to an electric lamp having a quartz glass envelope with a pinch seal and more particularly to a molybdenum foil coupling member used at the pinch seal.

2. Description of the Prior Art

Electric lamps having a quartz glass with a pinch seal in which a foil coupling member is incorporated as a current lead-through conductor are used widely in discharge lamps, in halogen lamps and so on.

The foil coupling member used in such lamps are usually made of pure molybdenum. In spite of the considerably different coefficients of thermal expansion of the quartz glass (approximately $5\text{–}6\times10^{-7}$ per deg. C.) and of molybdenum ($55\times10^{-7}$ per deg. C.) lamps having vacuum-tight pinch seals are nevertheless obtained. This is due to the ductility of molybdenum, to the shape of the foil, the knife edge of the foil extending in the longitudinal direction of the pinch, and to the small thick thickness of the foil, which is about 20–40 microns.

In a halogen lamp, for example, the molybdenum foil coupling member is respectively connected to an internal current conductor, in most cases consisting of tungsten, which has a much higher melting point than molybdenum and of molybdenum.

Lamps of the type described above are known from U.S. Pat. No. 4,254,300. In such lamps, the molybdenum foil contains yttrium oxide ($Y_2O_3$) in a quantity of from ¼ to 1% of the molybdenum weight to avoid fracture at a welded joint between the molybdenum foil coupling member and the internal current conductor.

A more serious problem than the aforementioned fracture, is cracking or tearing off of the molybdenum foil itself which mainly occurs during the sealing step, i.e., after making the weld between the molybdenum foil coupling member and internal and external current conductors when the sealing step proceeds. At the sealing step between the molybdenum foil coupling member and the quartz glass envelope, the end of the quartz glass envelope is heated with sealing burners above its melting point (more than 1500° C.). The pure molybdenum foil coupling member is simultaneously heated to a very high temperature by the sealing burners. After that, the end of the envelope is pinched with pinching jigs, and a pinch seal is formed.

Although molybdenum foil coupling members show high tensile strength, i.e., 70–90 kg/mm$^2$ in the normal temperature range, the molybdenum foil coupling member occasionally becomes torn or cracked owing to high temperatures during the sealing step.

The cracking or tearing of the molybdenum foil coupling member is a cause of short lamp life, bad vacuum seal and results in unusable articles of inferior quality.

SUMMARY OF THE INVENTION

Accordingly, an object of this invention is to provide an electric lamp having a quartz glass envelope with a pinch seal using a foil coupling member which shows a good resistance to tearing and cracking upon exposure to high temperature.

Another object of this invention is to provide an electric lamp showing a good vacuum seal through lamp life.

Yet another object of this invention is to provide an electric lamp having a long life.

These and other objects have been achieved according to this invention by providing a novel electric lamp having a molybdenum foil coupling member in which potassium and silicon dioxide are disposed.

BRIEF DESCRIPTION OF THE DRAWINGS

A more complete appreciation of this invention and many of the attendant advantages thereof will be readily obtained as the same becomes better understood by reference to the following detailed description when considered in connection with the accompanying drawings wherein.

DETALED DESCRIPTION OF THE PREFERRED EMBODIMENT

Figure 1:
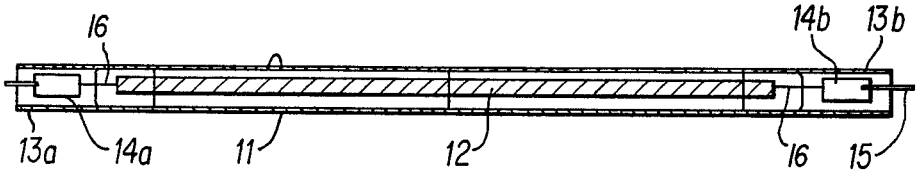
FIG. 1 is a schematic elevation of a halogen lamp for a copying machine.
Figure 2:
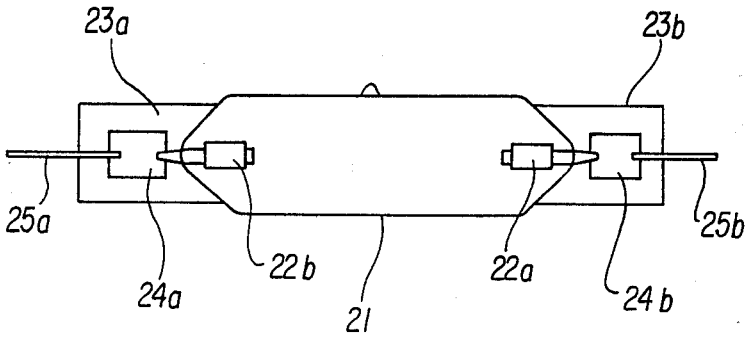
FIG. 2 is a schematic elevation of an arc tube for a mercury lamp.

Referring now to the drawings wherein like reference numerals designate identical or corresponding parts throughout the several views, and more particularly to FIGS. 1 and 2, thereof, a quartz glass envelope 11 of a 400 W halogen lamp has a tungsten filament 12 along its axis. The lamp envelope 11 has two pinch seals **13*a* and 13*b*, made by pinching at the both end thereof, each including potassium and silicon dioxide-containing molybdenum foil coupling members 14*a* and 14*b*, respectively, as current lead-through conductors. Each foil coupling member 14*a*, 14*b* is welded to an external current conductor 15 made of molybdenum and an internal current conductor 16 made of tungsten. The molybdenum foil coupling members 14*a*, 14*b***, each contain 500 ppm potassium (K) and 200 ppm silicon dioxide ($SiO_2$).

FIG. 2 shows a quartz arc tube 21, normally disposed in an outer envelope (not shown) of a 1 kw mercury lamp. The arc tube 21 has two pinch seals **23*a* and 23*b*, made by pinching at both ends thereof, each including potassium and silicon dioxide containing molybdenum foil coupling members 24*a* and 24*b*, as current lead-through conductors, to which external current conductors 25*a* and 25*b*, respectively, and electrodes 22*a* and 22*b* made of tungsten, respectively, are welded. The molybdenum foil coupling member 24** contains 600 ppm potassium (K) and 500 ppm silicon dioxide ($SiO_2$).

Crack testing of conventional molybdenum foil coupling members and the aforementioned molybdenum foil coupling member containing potassium and silicon dioxide was carried out in halogen lamps and mercury lamps. Average values of more than 1000 measurements are recorded in the following table.

TABLE

| | CONVENTIONAL LAMP | | | INVENTION LAMP | | |
|---|---|---|---|---|---|---|
| | NUMBER OF TESTS | GOOD ARTICLES | DEFECTIVE ARTICLES | NUMBER OF TESTS | GOOD ARTICLES | DEFECTIVE ARTICLES |
| HALOGEN LAMP | 1500 | 1454 | 46 | 1250 | 1250 | 0 |
| MERCURY LAMP | 1400 | 1382 | 72 | 1560 | 1560 | 0 |

The table shows that the foil coupling member of this invention has a good resistance to high temperatures and resulted in few defective articles.

The inventors also conducted lighting tests by selecting 100 conventional mercury lamps and 100 mercury lamps using the invention. With conventional lamps, three failed after lighting for 3000 hours. With lamps using the coupling member of the present invention, no failures occurred even after lighting for 6000 hours.

The molybdenum foil coupling member of this invention contains predetermined quantities of potassium (200–800 ppm) and silicon dioxide (200–2000 ppm), so that the recrystallization temperature of molybdenum rises. Consequently, the foil coupling member of this invention is better able to resist damage during the high temperature sealing step. It is therefore possible, using the invention, to heat even quartz glass envelopes to a sufficiently high temperature so that an excellent vacuum-tight pinch seal can be achieved. It is well known, of course, that quartz glass has a very high melting point.

The molybdenum foil coupling member of the invention, containing potassium and silicon dioxide, can be applied to other lamps using a quartz glass envelope, such as metal-halide lamps, xenon lamps, and so on.

Obviously other modifications and variations of the present invention are possible in light of the above teachings. It is, therefore, to be understood that within the scope of the appended claims, the invention may be practiced otherwise than as specifically described herein.

What is claimed as new and desired to be secured by Letters Patent of the United States is:

1. An improved molybdenum coupling member for use in electric lamps having increased resistance to mechanical failure at high temperatures comprising:

a molybdenum foil having predetermined quantities of potassium and silicon dioxide dispersed therein.

2. The improved coupling member of claim 1 wherein said predetermined quantity of potassium is in the range from 200 to 800 ppm and said predetermined quantity of silicon dioxide is in the range from 200 to 2000 ppm.

3. A quartz glass envelope for an electric lamp including an improved molybdenum coupling member having increased resistance to mechanical failure at high temperatures comprising:

a pinch seal portion at either end of said glass envelope, a molybdenum coupling member enclosed within each said pinch seal portion, said coupling member having predetermined quantities of potassium and silicon dioxide dispersed therein; and, an external conductor and a tungsten electrode welded to each said coupling member.

4. A quartz glass envelope for an electric lamp including an improved molybdenum coupling member as in claim 3, wherein:

said predetermined quantity of potassium is in the range from 200 to 800 ppm and said predetermined quantity of silicon dioxide is in the range from 200 to 2000 ppm.

* * * * *